US007193375B2

(12) United States Patent
Rudolph

(10) Patent No.: US 7,193,375 B2
(45) Date of Patent: Mar. 20, 2007

(54) ELECTRONIC BALLAST HAVING A PUMP CIRCUIT FOR A DISCHARGE LAMP HAVING PREHEATABLE ELECTRODES

(75) Inventor: Bernd Rudolph, Forstern (DE)

(73) Assignee: Patent-Treuhand-Gesellschaft fur Elektrisch Gluhlampen mbH (DE)

( * ) Notice: Subject to any disclaimer, the term of this patent is extended or adjusted under 35 U.S.C. 154(b) by 0 days.

(21) Appl. No.: 11/213,802

(22) Filed: Aug. 30, 2005

(65) Prior Publication Data

US 2006/0055339 A1 Mar. 16, 2006

(30) Foreign Application Priority Data

Sep. 13, 2004 (DE) ..... 10 2004 044 180

(51) Int. Cl.
*H05B 37/02* (2006.01)

(52) U.S. Cl. ..... 315/360; 315/291; 315/247; 315/307; 315/DIG. 5; 315/DIG. 7

(58) Field of Classification Search ..... 315/106, 315/194, 209 R, 200 R, 205, 247, 224, 219, 315/244, 291, 307, 360, 362, DIG. 5, DIG. 7, 315/276, 278
See application file for complete search history.

(56) References Cited

U.S. PATENT DOCUMENTS 5,008,597 A * 4/1991 Zuchtriegel ..... 315/209 R
5,677,602 A * 10/1997 Paul et al. ..... 315/224
5,877,592 A * 3/1999 Hesterman et al. ..... 315/106
5,994,848 A 11/1999 Janczak ..... 315/224
6,008,590 A * 12/1999 Giannopoulos et al. . 315/209 R
6,057,652 A * 5/2000 Chen et al. ..... 315/307
6,175,195 B1 * 1/2001 Janczak et al. ..... 315/194
6,232,727 B1 * 5/2001 Chee et al. ..... 315/307
6,326,740 B1 * 12/2001 Chang et al. ..... 315/291
6,433,490 B2 * 8/2002 Koch et al. ..... 315/224
6,753,659 B2 * 6/2004 Busse et al. ..... 315/209 R
6,933,681 B2 * 8/2005 Rudolph ..... 315/219
2005/0264243 A1 * 12/2005 Rudolph ..... 315/360

FOREIGN PATENT DOCUMENTS

| | | |
|---|---|---|
| DE | 103 03 276 | 7/2004 |
| DE | 103 03 277 | 7/2004 |
| EP | 1443807 A2 | 8/2004 |
| WO | WO 00/72642 A1 | 11/2000 |
| WO | WO 03/034794 A1 | 4/2003 |

OTHER PUBLICATIONS

Search Report from European Patent Office (for related foreign application) referencing the above-listed patent documents, dated Dec. 2, 2005 (6 pages total).

* cited by examiner

*Primary Examiner*—Haissa Philogene
(74) *Attorney, Agent, or Firm*—Fitch, Even, Tabin & Flannery

(57) ABSTRACT

The invention relates to an electronic ballast for discharge lamps LA1, LA2 having preheatable electrodes which has a pump circuit D5/D7, D6/D8 for improving the power factor. In this arrangement, preheating is performed with a converter frequency, raised by comparison with continuous operation, and with the aid of a preheating transformer TR2.

6 Claims, 5 Drawing Sheets

ELECTRONIC BALLAST HAVING A PUMP CIRCUIT FOR A DISCHARGE LAMP HAVING PREHEATABLE ELECTRODES

FIELD OF THE INVENTION

The present invention relates to an electronic ballast that is designed for operating lamps having preheatable electrodes.

BACKGROUND OF THE INVENTION

Such lamps and ballasts have been known per se for a long time. Use is made in one group of appliances of a so called PTC element (a resistor with a decidedly positive temperature coefficient) for stipulating a preheating time when such a lamp is restarted. The PTC element is heated up during preheating by a current and terminates the preheating operation by increasing its electric resistance.

The control of the converters, in particular of the switching transistors used therein, can be performed, on the one hand, by feedback, in which case a so called self-excited converter is spoken of. On the other hand, it is also known to control converters externally by means of a sequential control system and, in the process, particularly to influence the operating frequency of the converter, for example in order to control the lamp current in continuous operation.

As a rule, the ballasts are designed for operating on an ac voltage supply system. A rectifier is used to generate an intermediate circuit dc voltage that is used to supply a converter which, in turn, generates a supply of power of higher frequency than the system frequency for the purpose of operating the lamp.

An important property of such ballasts is the way in which power is drawn from the ac voltage supply system. When the rectifier charges an intermediate circuit storage capacitor, abrupt charging processes come about in the intermediate circuit storage capacitor without any further measures when the instantaneous system voltage is above the capacitor voltage. This generates line current harmonics and causes a poor power factor.

There are various possibilities for improving the power factor, that is to say for reducing the line current harmonics. The corresponding properties of electronic ballasts are also covered in part by regulations, for example IEC1000-3-2. In addition to dedicated converters for charging the intermediate circuit storage capacitor (or, more generally, main energy store) from the rectified system voltage, so called pump circuits also come into consideration. The latter require a comparatively low outlay on circuitry.

It is inherent in the topology of a pump circuit that the power rectifier is coupled to the intermediate circuit storage capacitor via at least one electronic pump switch. This results in a pump node between the power rectifier and the electronic pump switch. Said pump node is coupled to the converter output via a pump network. The pump network can include components that at the same time can be assigned to a matching network for coupling the lamp to the converter output. The principle of the pump circuit consists in withdrawing energy from the rectified system voltage via the pump node during a half period of the converter frequency, and buffering it in the pump network. In the subsequent half period, the buffered energy is fed to the intermediate circuit storage capacitor via the electronic pump switch.

Energy is consequently withdrawn from the rectified supply voltage in step with the converter frequency. In general, the electronic ballast includes filter circuits that suppress spectral components of the line current in the region of the converter frequency and above. The pump circuit or circuits can be designed such that the line current harmonics comply with the abovementioned regulations or other requirements.

As regards pump circuits, reference may otherwise be made to the prior art, specifically in particular to the applications DE 103 03 276.2 and DE 103 03 277.0 from the same applicant and to the citations there.

SUMMARY OF THE INVENTION

The invention is based on the technical problem of specifying an electronic ballast that is improved with regard to the preheating of lamp electrodes and which has a pump circuit.

The invention is directed to an electronic ballast for a discharge lamp having preheatable electrodes, which ballast has:

- an ac voltage supply terminal,
- a rectifier connected to the supply terminal,
- a converter for generating a higher-frequency supply power for the discharge lamp from the supply power, rectified by the rectifier, of the supply terminal,
- a pump circuit for improving the power factor of the ballast by drawing energy from the ac voltage supply terminal, characterized in that the ballast includes a preheating transformer that is designed to supply a preheating power to the preheatable electrodes, which are connected on the secondary side to the lamp, doing so during a preheating phase before said lamp is ignited, the ballast being designed to operate the converter during preheating with a frequency that is raised by comparison with the open circuit resonant frequency of the ballast, in order to supply the primary side of the preheating transformer, and to a corresponding method for operating a lamp.

Preferred refinements of the invention are specified in the dependent claims and are explained in more detail below. The disclosure always relates here both to the method category and to the device category of the invention. The inventor has proceeded from the fundamental consideration that a pump circuit continues to constitute a possibility for power factor correction that is attractive because it is simple and effective.

He has further looked for a solution in which a sequential control system is used instead of a PTC element for defining the preheating phase. The main problem arising here is that the energy dissipated by the PTC element in the course of the heating process is eliminated. The energy pumped by the pump circuit must therefore be dissipated in another way during preheating. It has been observed that the pump action of the pump circuit can generally pump more energy than is required for preheating the electrodes. Components, in particular the intermediate circuit storage capacitor, can experience overloading in this case through the voltage rising to impermissible values.

However, this can be prevented by reducing the pump action of the pump circuit, specifically in a particularly simple and efficient way by raising the frequency. Thus, the invention provides that a substantially higher converter frequency is used during preheating by comparison with the open circuit resonant frequency.

Expressed in a simplified way, the lowering of the effective pump action with the frequency is associated with the fact that the resonant behavior of the resonant circuit including the lamp has a frequency dependence that overcompensates the frequency dependence of the capacitive pumping and inductive pumping. In approximate terms, the effective pump power is lowered in a fashion approximately proportional to the reciprocal of the square of the frequency in the case of capacitive pump circuits, and in a fashion approximately inversely proportional to the frequency in the case of inductive pump circuits.

In particular, the frequency used during preheating can be 1.3 times higher than the open circuit resonant frequency, frequencies 1.4, 1.5, 1.6, 1.7, 1.8, 1.9 times higher or approximately at or above two times higher increasingly being preferred so that the pump action is significantly reduced by comparison with the operation. The open circuit resonant frequency is in this case the resonant frequency, usually so denoted, of the lamp circuit without a lamp connected, which results in the way generally known essentially from the inductance of the lamp inductor and the capacitance of the resonance capacitor.

Finally, the invention provides a preheating transformer with the aid of which it is possible to generate a current that is sufficiently strong for preheating. Otherwise, there is the risk that because of the inductor effect of the lamp inductor, the current will become too small at the preferred relatively high preheating frequencies, this rendering it impossible to attain an adequate preheating effect with regard to the current (not the energy). The raising of the preheating frequency in accordance with the invention thus initially counteracts the generation of sufficiently strong preheating currents. This problem can be eliminated, however, by means of the abovementioned preheating transformer.

It can therefore be achieved overall that in the case of preheating with an electronic ballast having a pump circuit and without a PTC element, so high a converter frequency is used that the preheating energy produced by the converter lies at most at the maximum permissible preheating energy of the respective lamp electrodes. Such preheating energies can, for example, be assigned to each lamp electrode in accordance with the energy-controlled preheating in compliance with IEC81 or IEC901.

Furthermore, the preheating transformer offers a dc isolation relative to the electrodes, which is likewise advantageous in many instances.

It is possible, overall, to avoid the disadvantages of the frequently used PTC elements that are, for example, still hot and of high resistance after relatively short system pauses such that there is then insufficient preheating of the lamp electrodes and therefore a deleterious cold start. Furthermore, PTC elements exhibit losses that on the one hand worsen the efficiency of the ballast, and on the other hand lead to a frequently undesired additional heating associated with correspondingly greater problems with reference to waste heat and the durability of the components and soldering points. Furthermore, in the case of more modern lamps (for example T5 design), substantial voltage loads occur in the case of series circuits, above all, which likewise can no longer be implemented directly with PTC elements. Finally, switching off the pump circuit during preheating is superfluous, and thus also is the necessity for correspondingly designed switches and, in particular, for stress-proof driver circuits (high side drivers).

On the other hand, it is preferred within the scope of the invention to provide a switch for switching off the preheating transformer. It is possible thereby after preheating also to avoid withdrawing energy by the preheating circuit no matter how small the amount. This is important chiefly whenever the aim is to operate lamps in the case of which there are particularly critical requirements with reference to lamp temperature and the aim is therefore to suppress (cut off) any sort of additional introduction of heat, for example owing to a small residual heating current during continuous operation. When this is not so decisive, or there is another possibility for suppressing residual heating currents in continuous operation, it is preferred to make use of the lamp inductor, which is present in any case, as primary winding of the preheating transformer, that is to say provide the lamp inductor with a few additional windings that are possible with a very low cost outlay. One possibility of at least reducing residual heating currents in continuous operation consists, for example, in switching a capacitor into the preheating circuit, that is to say on the secondary side of the preheating transformer. In the case of the raised preheating frequencies according to the invention, said capacitor has a relatively low impedance and therefore does not interfere much; however, its impedance rises in normal operation owing to the frequency reduction. Such a capacitor also has other advantages, specifically dc current blocking. This can be important, for example, in conjunction with the detection of filament breakage (not discussed in detail within the scope of this invention), in the case of which use is made of the ability of the lamp electrodes to conduct direct current. Here, the secondary windings lying in parallel in the preheating circuits can interfere, but would be isolated in terms of direct current by the capacitor.

A further possibility, which is, however, less preferred within the scope of this invention for various reasons, consists in utilizing a resonance in the case of the preheating frequency, particularly in the preheating circuit itself. However, problems can also arise in continuous operation owing to excitation of resonance by harmonics, in which case it has also to be borne in mind that the voltage characteristics produced by the converter in continuous operation are regularly not sinusoidal and therefore rich in harmonics.

In the case of the ballast according to the invention, it is preferred to provide a lamp current or lamp power control that varies the converter frequency during continuous operation of the lamp such that a specific desired value is met. This is ultimately performed by bringing the converter frequency nearer to, or removing it from the resonant frequency of the lamp resonant circuit including the lamp.

Furthermore, a preferred refinement of the invention provides a voltage control circuit that is used to set the starting voltage of the lamp resonant circuit via the frequency of the converter of the ballast. This voltage control circuit is advantageous because a relatively accurate setting of frequency is required when starting via resonance excitation because of the quality of the lamp resonant circuit. The control circuit can now match the frequency to the resonance behavior of the lamp resonant circuit, or "move it subsequently", and, in particular, in so doing operate by limiting the starting voltage through varying the frequency.

The previously mentioned control circuit for the lamp current or power can be combined with the voltage control circuit to the extent that both access the same control input for controlling the operating frequency of the converter. It can preferably be provided in this case that the circuit functions as a current or power control circuit (that is to say continuous-operation control circuit) as soon as appreciable lamp currents flow, that is to say the lamp has started, while in the other case the voltage regulation "takes precedence".

The abovementioned combination of continuous-operation circuit and voltage control circuit can, furthermore, be designed in order to apply the lamp voltage, a potential derived therefrom or another variable correlating therewith to an input of the control amplifier or switching transistor of the continuous-operation control circuit. Of course, it can also suffice to use only a temporal component of the lamp voltage or of the correlating variable. The object of this is to deactivate the continuous-operation control circuit during preheating and starting until the lamp has switched on and reached its running voltage. The preheating and starting operations can therefore proceed without disturbance, and the continuous-operation control circuit is used only in continuous operation.

Furthermore, it is preferred to advance relatively quickly to the ignition after the actual preheating process, that is to say after the lamp electrodes have reached the required temperature. Specifically, when the frequency drop then present results too slowly starting at the preheating frequency, the overloading of components mentioned at the beginning can occur even in this transition phase owing to the excessive pump action of the pump circuit. Transition times of at most 10 ms, preferably below 8, 6, 4, 2 or 1 ms, have proved themselves here. It is conventional here to make use, however, of time intervals of the order of magnitude of 100 ms.

The invention is explained below in more detail with the aid of exemplary embodiments, the individual features being important, as already mentioned, both for the device category and for the method category, and also possibly being essential to the invention in other combinations, in addition.

BRIEF DESCRIPTION OF THE DRAWING(S)

FIGS. 1*a–b* show a circuit diagram of a first exemplary embodiment according to the invention. For reasons of space, the circuit diagram is split into FIGS. 1*a* and 1*b*. In what follows, references to FIG. 1 are understood as a reference to the respective subfigure 1*a* or 1*b*.

FIGS. 2*a–b* show a circuit diagram of a second exemplary embodiment according to the invention. For reasons of space, the circuit diagram is split into FIGS. 2*a* and 2*b*. In what follows, references to FIG. 2 are understood as a reference to the respective subfigure 2*a* or 2*b*.

DETAILED DESCRIPTION OF THE INVENTION

Figure 1A:
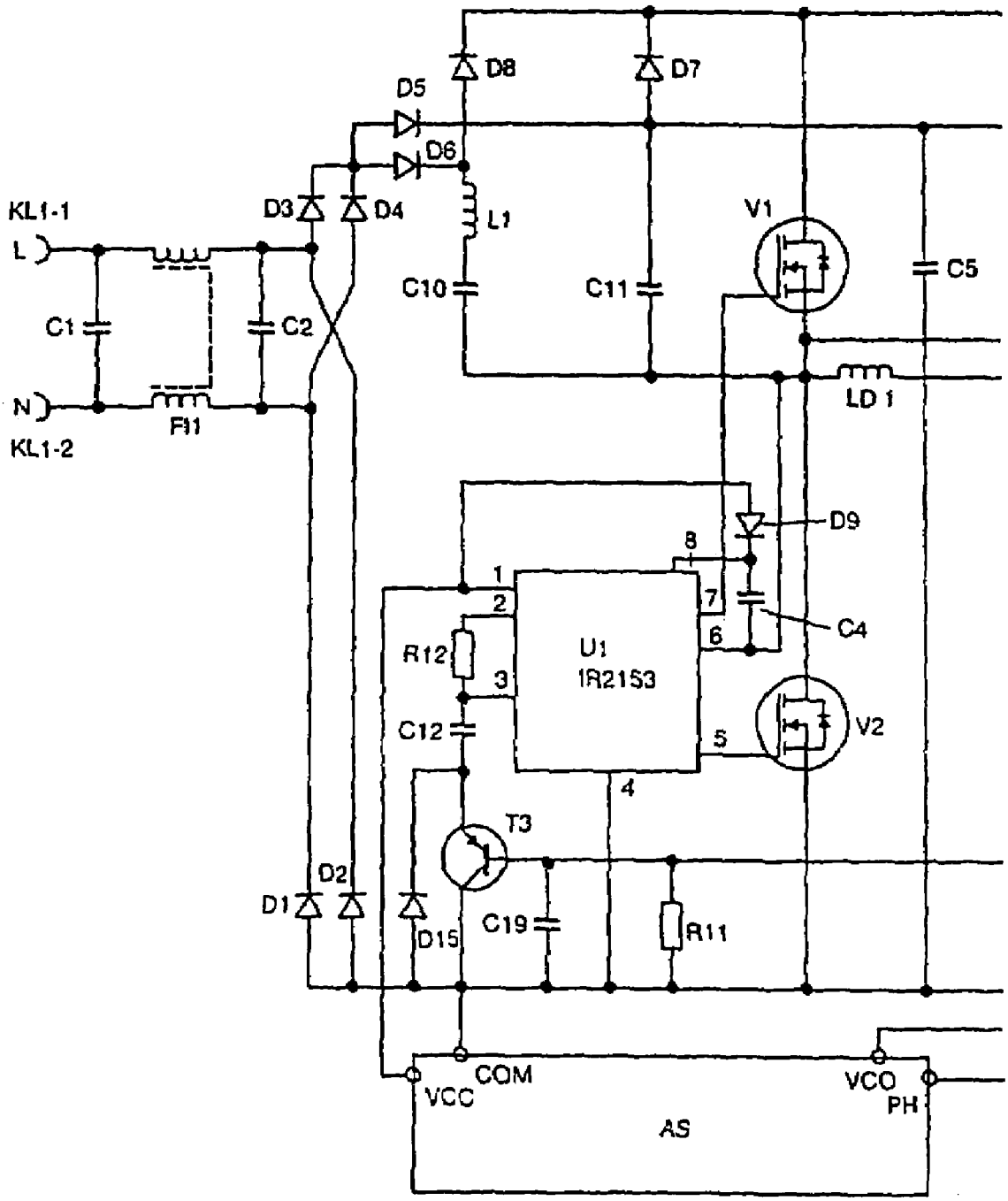
Figure 1B:
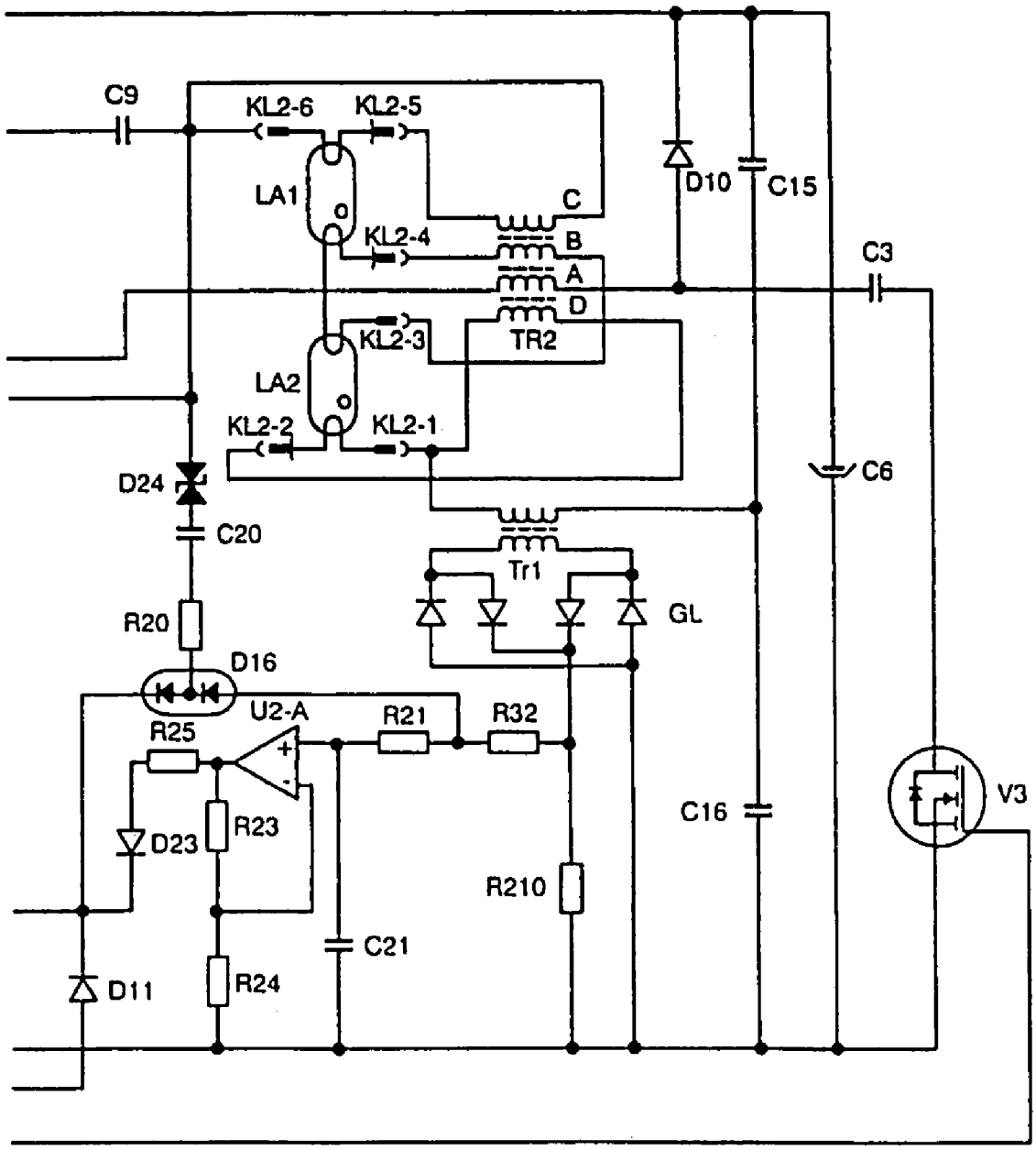

FIG. 1 shows a first exemplary embodiment. Drawn in at the left are two terminals KL1-1 and KL1-2 to which a system voltage is to be connected. A filter composed of two capacitors C1 and C2 and two coupled coils denoted by F11 connects the system voltage terminals to a full bridge rectifier composed of the diodes D1–D4. A pump circuit has two pump branches that include diodes D5–D8 via which the rectified supply voltage is applied to an intermediate circuit storage capacitor C6, which is depicted at the far right in the figure.

The intermediate circuit capacitor C6 feeds the converter, which is constructed here as a half bridge composed of two switching transistors V1 and V2. By being clocked appropriately in phase opposition, the half-bridge transistors V1 and V2 generate at their center tap an ac voltage that oscillates between the two potentials of the rectifier output. This ac voltage is connected to the supply branches via a lamp inductor LD1 and, in the present case, a series circuit of two discharge lamps LA1 and LA2 and a measurement transformer TR1, explained in still greater detail below, via two coupling capacitors C15, C16.

FIG. 1 shows that not only a current can flow through the discharge plasma in the lamps LA1 and LA2, but that also a preheating current can flow through the upper electrode of the upper lamp LA1, the lower electrode of the lower lamp LA2, the two interconnected electrodes of the lamp LA1 and the lamp LA2, and a respective secondary winding of a heating transformer TR2.

In order to meet relevant regulations with reference to line current harmonics, for example IEC 1000-3-2, use is made here of a pump circuit having two pump branches and which proffers a comparatively low outlay on circuitry. In principle, the rectifier is coupled here to the main energy store, the intermediate circuit storage capacitor C6, via an electronic pump switch D6/D8 or D5/D7. The pump nodes lying between the diodes D5 and D7, and D6 and D8, are coupled via a pump network to the output of a converter or inverter that is explained in more detail later. Consequently, during a half period of the inverter frequency, energy is drawn from the system voltage via the pump nodes and buffered in a pump network. In the half period following thereupon, the buffered energy is fed to the intermediate circuit storage capacitor C6 via the electronic pump switch, here the diodes D8 and D7. Energy is thereby withdrawn from the system in time with the inverter frequency. The abovementioned filter elements largely suppress higher spectral components, and so line current is ultimately consumed in a quasi-sinusoidal fashion.

The details of the pump circuit are not important for the present invention. Reference is made here to the prior art and, in particular, to the applications DE 103 03 276.2 and DE 103 03 277.0 from the same applicant. What is important is that the pump branches can pump energy into the circuit with each period of the inverter, but cannot return it.

In addition to the already mentioned lamp inductor LD1, the lamp resonant circuit has resonance capacitors C5 and C9.

The lamp resonant circuit is used firstly to raise the voltage by means of an excitation close to resonance. After ignition, the lamp resonant circuit secondly acts as a matching network that transforms the output impedance of the inverter into an impedance suitable for operating the discharge lamps.

Otherwise, the lamp resonant circuit also acts as a pump network. If the voltage at the pump nodes already mentioned is lower than the instantaneous system voltage, the pump network draws energy from the system. In the inverse case, the energy drawn is output to the intermediate circuit capacitor C6. A further pump action proceeds from the capacitor C8. The capacitor C8 acts as a so called trapezoidal capacitor for relieving the switching load on the half-bridge transistors V1 and V2. The pump network for the second pump branch comprises a series circuit of a pump inductor L1 and a pump capacitor C10.

The half-bridge transistors V1 and V2, which are designed as MOSFETs, are driven at their gates by an integrated driver circuit, for example International Rectifier type IR2153. This IC also includes a high side driver for driving the "high" half-bridge transistor V1. The diode D9 and the capacitor C4 are provided in this context.

Apart from the driver circuits for the half-bridge transistors V1 and V2, the IC includes an oscillator whose frequency can be set via the terminals 2 and 3 (RT and CT). The frequency in accordance with RT and CT corresponds to the lowest operating frequency of the half bridge. A frequency-determining resistor R12 is connected between the terminals 2 and 3. Connected between the terminal 3 and the lower supply branch serving as reference potential is a frequency-determining capacitor C12, and connected in series therewith is the emitter-collector path of a bipolar transistor T3. A diode D15 is connected in parallel with the emitter-collector path in order to be able to charge and discharge C12. The half-bridge frequency can be set by means of a voltage between the base terminal of the bipolar transistor T3 and the reference potential, and thereby forms a manipulated variable for a control loop. The base terminal of the bipolar transistor T3 is driven by circuit parts depicted further right in FIG. 1. The bipolar transistor and the IC as well as the associated wiring therefore form a controller.

The functions of the IC and the associated wiring can also be implemented by any desired voltage- or current-controlled oscillator circuit that accomplishes the drive of converter transistors via driver circuits. Otherwise, the inverter described is controlled by a sequential control system AS that is depicted at the bottom in FIG. 1.

In the exemplary embodiment, the controller acquires the lamp current as controlled variable, specifically the discharge current, to put it more precisely. The latter is acquired via a measurement transformer TR1. A further known lamp current measurement that can also be applied could be performed via one of the two coupling capacitors C15, C16 or a component thereof acquired on a measuring shunt. A full-bridge rectifier GL rectifies the current and leads it to the reference potential via a low-resistance measuring shunt R21D. The voltage drop across R21D is entered into the input of a non-inverting measuring amplifier in the form of an operational amplifier U2-A via a lowpass filter composed of the resistor R21 and the capacitor C21, which serves for averaging. This measuring amplifier is connected in a known way by the resistors R23–R25 and passes its output signal to the controller input (manipulated variable node) described via the diode D23. This closes the current control loop which was denoted previously as the continuous-operation control circuit. The diode D23 in this case decouples the output of the measuring amplifier U2-A from the voltage divider D24, C20, R20, D16, R11, when the potential at the tie point LD1–D24 is sufficiently high. According to the invention, the circuit arrangement is designed in this case such that without a discharge current the voltage at the anode of the diode D23 assumes a value defined by the output VCO of the sequential control system AS via a diode D11, that is to say the sequential control system AS determines the start frequency.

The sequential control system AS thus stipulates via the output VC0 a frequency value that is more than double the open circuit resonant frequency.

The inverter is therefore operated at a prescribed preheating frequency and is applied correspondingly to the primary winding A of the preheating transformer TR2. Consequently, corresponding preheating currents flow into the secondary windings B, C and D.

In this arrangement, the capacitor C3 serves for setting an average voltage between the voltages across the intermediate circuit storage capacitor C6 as reference potential for the right-hand terminal for the primary winding A.

After a preheating time prescribed by the sequential control system AS, the sequential control system AS goes over into the ignition mode within approximately 1 ms and generates the required starting voltage by means of resonant amplification in the lamp resonant circuit. The preheating circuits can be switched off simply after preheating by means of the switch V3 that is in series with the primary winding A of the preheating transformer TR2 and can be controlled via the output PH of the sequential control system AS. Any further dissipation of energy in the preheating circuits is thereby suppressed in common with an unnecessary introduction of heat into the lamps LR1 and LR2 by the electrodes.

Since the starting phase for the half-bridge switches V1 and V2 and the lamp resonant circuit (LD1, C5, C9) which follows the preheating constitutes a high load, a protective circuit is provided here for avoiding excessively high starting voltages. However, this protective circuit simultaneously also forms a voltage control circuit for setting the starting voltage to a suitable value. This purpose is served by a suppressor diode D24 at the lamp-side terminal of the lamp inductor LD1. It will also be possible here to use a metal oxide varistor or a zener diode instead of a suppressor diode. It is therefore a threshold switch that is involved. The threshold switch, which here lies in the high voltage range, can, however, also be omitted, and an appropriate threshold circuit can be provided in the low voltage range, that is to say in the range of the evaluation. This is not depicted here, but is immediately clear to the person skilled in the art.

Via a series circuit having a capacitor C20 and a resistor R20, the lamp voltage is given starting from a specific threshold value between two diodes D16. The anode of the left-hand diode constitutes a second control input. The value of the resistor R20 influences the level of influence of the intervention in the control loop, which is outlined below.

The lamp voltage tapped via the suppressor diode D24 forms a measure of the reactive energy oscillating in the lamp resonant circuit, and of the starting voltage. If this voltage exceeds the threshold value of the suppressor diode D24, the half-bridge frequency is raised, and the reactive energy oscillating in the resonant circuit is thereby reduced, and on the other hand the lamp voltage is diminished.

A typical value for the threshold of the suppressor diode D24 is 250 V, for example. The voltage control circuit then exerts control above this voltage.

After ignition, a lamp current flows that raises the potential of the anode of the diode D23 to a value that is in the operating range of the bipolar transistor T3, and thereby closes the control loop of the continuous-operation control circuit (for the lamp current).

On the other hand, in the case of a lamp voltage lying above the threshold value of the suppressor diode D24, the voltage at the positive input of the control amplifier U2-A is raised via the right-hand diode D16, which drives a tap between the resistors R22 and R32 at said input. The continuous-operation control circuit can thereby be rendered inoperative when a starting attempt is being made. This is a factor of interest in order not to permit any disturbances during starting. For example, in the exemplary embodiment outlined the control of the lamp current, that is to say the continuous-operation control circuit, operates with a time constant of the order of magnitude of 1 ms. On the one hand, with this setting the substantially faster converter frequencies are adequately filtered, while on the other hand the control is thereby approximately one order of magnitude faster than the 100 Hz modulation, unavoidable owing to the rectified system voltage, of the intermediate circuit voltage across the storage capacitor C6. However, under poor conditions, in particular with older lamps, a starting burst exceeding 1 ms may be required in order to achieve reliable starting. It is thus then an advantage to switch off the current control.

By applying a (negative) component of the high lamp voltage via the components D24, C20, R20, D16 to the non-inverting input of the control amplifier U2-A, the continuous-operation control circuit is blocked in this case such that the voltage control circuit already described remains operative.

Figure 2A:
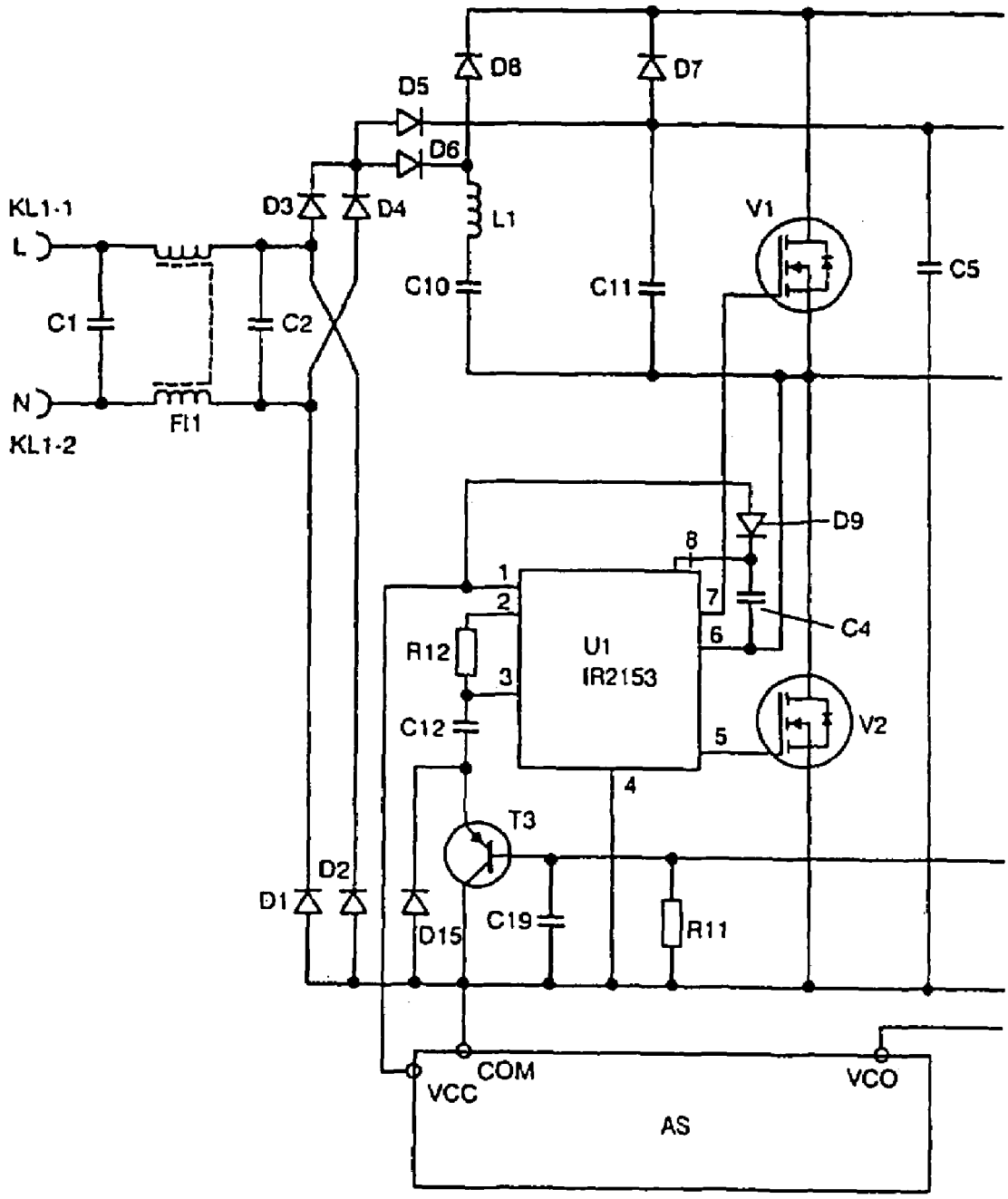
Figure 2B:
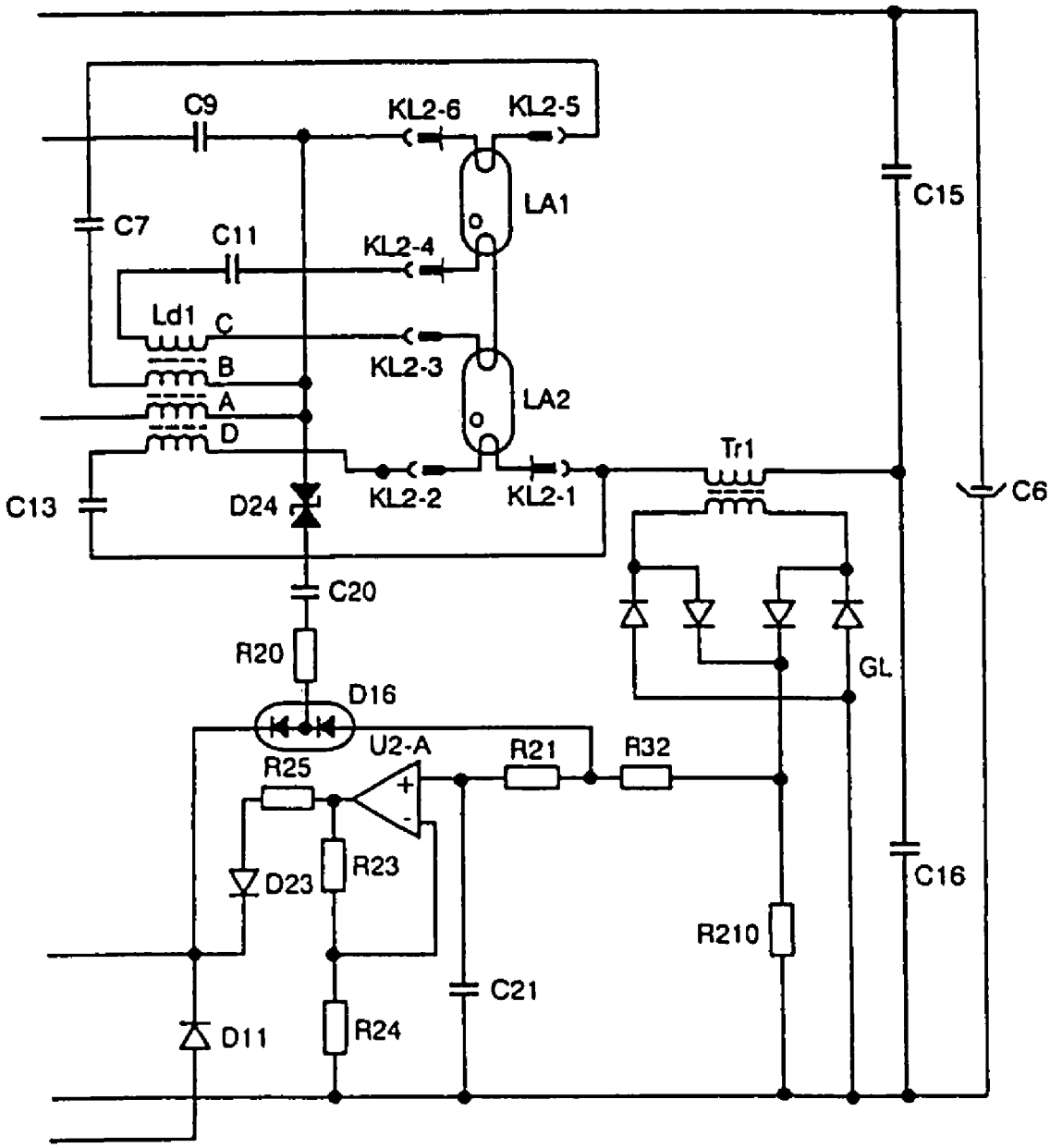

FIG. 2 shows a second exemplary embodiment for which the explanations relating to the first exemplary embodiment are largely valid. The same reference symbols are entered for identical or corresponding parts.

The differences are as follows: for the purpose of simplification, the lamp inductor LD1 and the preheating transformer TR2 from FIG. 1 are combined here. The lamp inductor LD1 thus corresponds to the primary winding A of the preheating transformer. Its function otherwise remains unchanged, but it can no longer be switched off, that is to say the switch V3 and the corresponding control output PH from FIG. 1 are absent. As a consequence of the unification of the primary winding and the lamp inductor, it would also be possible, specifically, for the preheating circuits to be switched off only on the secondary side, and this would be complicated because of the participating voltages and the corresponding effects on the driver circuits required. Instead of this, the individual preheating circuits each include a capacitor C7, C11 and C13, respectively. Said capacitor has the function already outlined earlier of forming a higher impedance in continuous operation than during preheating. Furthermore, the capacitors C7, C11 and C13 for a filament breakage detection (not depicted here) have, owing to the dc conductivity, the advantage of dc disconnection despite secondary windings B, C and D lying in parallel with the electrodes. Moreover, this last-named function can also be implemented in the case of the exemplary embodiment from FIG. 1, in which case it would also be possible to use diodes instead of the capacitors.

The first exemplary embodiment has the advantage of a complete disconnection of the preheating circuits, and is therefore especially suitable for particularly efficiency-optimized lamps that are sensitive to the introduction of heat with regard to their efficiency. The second exemplary embodiment from FIG. 2 is particularly simple and cost effective because in fact only three capacitors (which are, however, optional in any case) and three additional windings on the lamp inductor are required.

The invention may be illustrated with a few quantitative data with the first exemplary embodiment (FIG. 1). Two 36 W tubular fluorescent lamps are operated in this example, the elements determining the pump effect being dimensioned as follows:

LD1=1 mH

L1=1.8 mH

C5=10 nF

C9=14 nF

C10=220 nF

C15=C16=100 nF.

Figure 3:
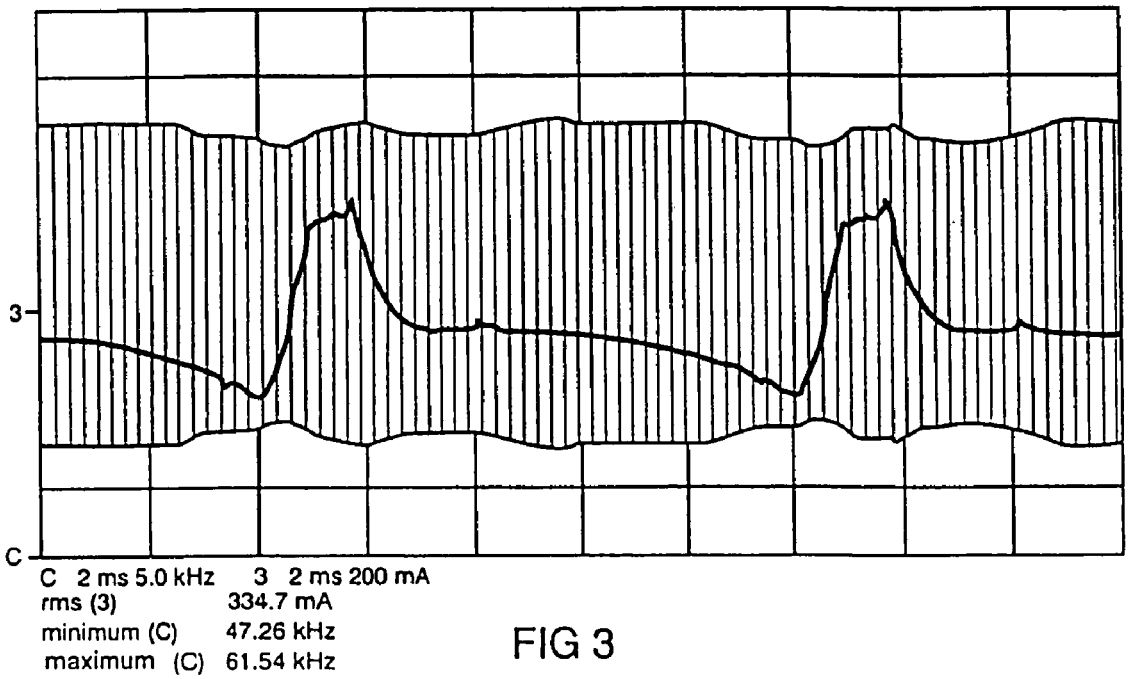
FIG. 3 shows actual measurement curves for quantitative illustration of the second exemplary embodiment.

The lamp current actually oscillating at the operating frequency in continuous operation is shown by the surface (channel 3) filled by hatching in FIG. 3. Here, the lamp current has a root-mean-square value of approximately 335 mA given nominal conditions of 230 V supply voltage at 50 Hz. Channel C, that is to say the continuous black line, shows the operating frequency fluctuating between a minimum value of approximately 47.3 kHz and a maximum value of approximately 61.5 kHz. The fluctuations originate from the lamp current control via the operating frequency. The remaining fluctuations in the lamp current are caused, inter alia, by the time constant of the control.

The open circuit resonant frequency (determined by LD1 and C9) is at 42.6 kHz, and the starting frequency (given an open-circuit voltage of 700 V) is approximately 48 kHz.

Figure 4:
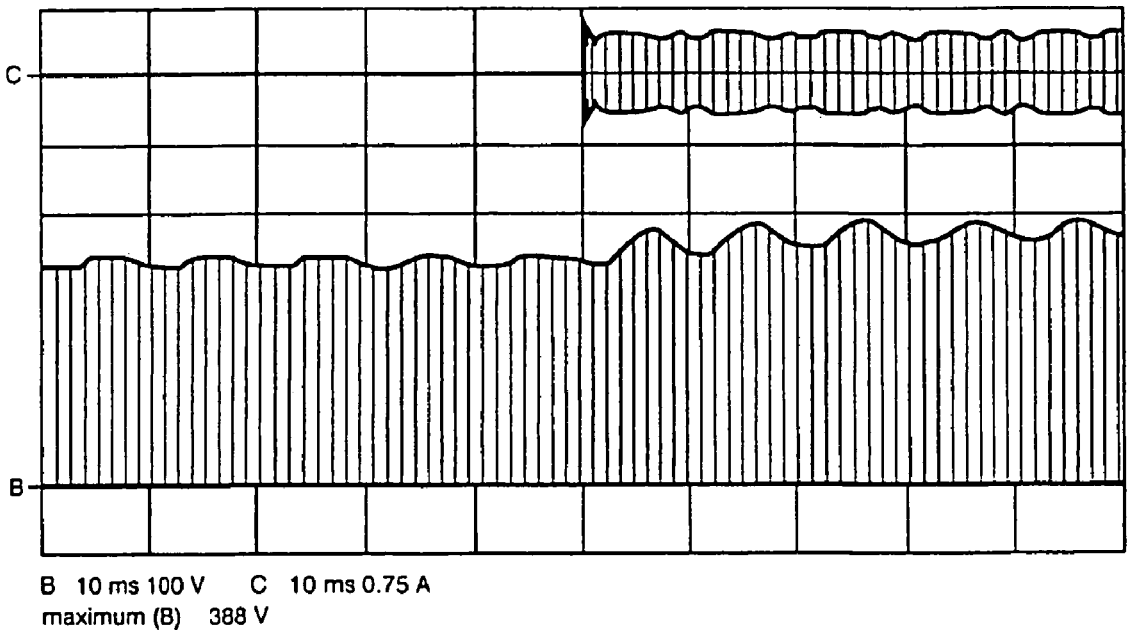
FIG. 4 shows actual measurement curves for quantitative illustration of the second exemplary embodiment.

FIG. 4 shows, using the channel B, represented by hatching, the characteristic of the intermediate circuit voltage $U_{C6}$ in the vicinity of a starting process. The preheating frequency here is 98.5 kHz, that is to say more than double the open circuit resonant frequency.

It is well in evidence that the intermediate circuit voltage $U_{C6}$ does not exceed the peak value of the system voltage (approximately 325 V) until after the starting in the middle of the diagram, which can be detected from the lamp current represented in channel C, and before that remains below this amplitude. The lamp current in channel C of FIG. 4 corresponds to channel 3 in FIG. 3.

The invention claimed is:

1. An electronic ballast for at least one discharge lamp having preheatable electrodes, the ballast comprising:

an ac voltage supply terminal, a rectifier connected to the supply terminal, a converter for generating a higher-frequency supply power for the discharge lamp from the supply power, rectified by the rectifier, of the supply terminal, at least one pump circuit for improving the power factor of the ballast by drawing energy from the ac voltage supply terminal, and characterized in that:

the ballast further comprises a preheating transformer having a primary side and a secondary side, wherein the ballast and the preheating transformer are designed to supply a preheating power to the preheatable electrodes of the lamp during a preheating phase before the lamp is ignited, wherein the preheatable electrodes are connected on the secondary side of the preheating transformer, the ballast is designed to operate the converter during preheating with a frequency that is raised by comparison with an open circuit resonant frequency of the ballast, in order to supply the primary side of the preheating transformer, and wherein the ballast further comprises a sequential control system for controlling the operation of the converter, wherein the sequential control system is designed so that the transition from the preheating phases, with the converter frequency raised by comparison with a continuous-operation frequency, to the ignition of the discharge lamp (LA1, LA2) takes at most 10 ms.

2. The ballast as claimed in claim 1, wherein the ballast includes a switch for switching off the preheating transformer, wherein the switch is provided in series with the preheating transformer.

3. The ballast as claimed in claim 1, in which the primary winding of the preheating transformer is formed by a lamp inductor of the ballast.

4. The ballast as claimed in claim 2, further comprising a capacitor which is connected between the secondary side of the preheating transformer and one of the preheatable electrodes.

5. The ballast as claimed in claim 1, further comprising a continuous-operation control circuit for controlling the lamp current or the lamp power during continuous operation of the lamp via the operating frequency of the converter.

6. The ballast as claimed in claim 1, further comprising a voltage control circuit for setting the starting voltage of a lamp resonant circuit upon ignition of the discharge lamp via the operating frequency of the converter.

* * * * *